US011132930B2

(12) United States Patent
Wu et al.

(10) Patent No.: US 11,132,930 B2
(45) Date of Patent: Sep. 28, 2021

(54) DISPLAY DEVICE, SOURCE DRIVE CIRCUIT AND DISPLAY SYSTEM

(71) Applicant: Chipone Technology (Beijing) Co., Ltd., Beijing (CN)

(72) Inventors: Zhaocheng Wu, Beijing (CN); Jun Zhu, Beijing (CN)

(73) Assignee: CHIPONE TECHNOLOGY (BEIJING) CO., LTD., Beijing (CN)

( * ) Notice: Subject to any disclaimer, the term of this patent is extended or adjusted under 35 U.S.C. 154(b) by 78 days.

(21) Appl. No.: 16/651,319

(22) PCT Filed: Aug. 22, 2018

(86) PCT No.: PCT/CN2018/101703
§ 371 (c)(1),
(2) Date: Sep. 2, 2020

(87) PCT Pub. No.: WO2019/062394
PCT Pub. Date: Apr. 4, 2019

(65) Prior Publication Data

US 2021/0110756 A1 Apr. 15, 2021

(30) Foreign Application Priority Data

Sep. 26, 2017 (CN) ..... 201710884727.4

(51) Int. Cl.
*G09G 3/20* (2006.01)

(52) U.S. Cl.
CPC ..... *G09G 3/2007* (2013.01); *G09G 2300/08* (2013.01); *G09G 2310/027* (2013.01);
(Continued)

(58) Field of Classification Search
None
See application file for complete search history.

(56) References Cited

U.S. PATENT DOCUMENTS

2004/0041763 A1* 3/2004 Kodama ..... G09G 3/3688 345/87
2005/0243043 A1* 11/2005 Jeoung ..... G09G 3/3688 345/87

(Continued)

FOREIGN PATENT DOCUMENTS

CN 1677472 10/2005
CN 101118728 2/2008

(Continued)

*Primary Examiner* — Kent W Chang
*Assistant Examiner* — Benjamin Morales
(74) *Attorney, Agent, or Firm* — Treasure IP Group, LLC

(57) ABSTRACT

Disclosed is a display device, a source driving circuit and a display system, the source driving circuit (2200) comprises a plurality of source driving units (2210); a power supply line used for supplying a power supply voltage (VSP), and a plurality of power supply nodes are distributed on the power supply line, each source driving unit is connected to a corresponding power supply node so as to receive the power supply voltage. The source driving circuit further comprises an equalization line, having a receiver end for receiving an equalizing voltage, when a first enable signal is active, the equalization line provides the equalizing voltage to each source driving unit, and when the first enable signal is not active, the equalization line stop receiving the equalizing voltage, and at least a portion of the equalization line can be connected in parallel to at least a portion of the power supply line.

13 Claims, 6 Drawing Sheets

(52) U.S. Cl.
CPC ..... *G09G 2310/0251* (2013.01); *G09G 2310/0267* (2013.01); *G09G 2330/028* (2013.01)

(56) References Cited

U.S. PATENT DOCUMENTS

| | | | | |
|---|---|---|---|---|
| 2006/0202929 | A1* | 9/2006 | Baum | G09G 3/3696 345/89 |
| 2008/0136806 | A1* | 6/2008 | Lee | G09G 3/3688 345/212 |
| 2012/0081338 | A1* | 4/2012 | Kim | G09G 3/3614 345/204 |
| 2013/0234918 | A1* | 9/2013 | Yamashita | G09G 3/3258 345/84 |
| 2020/0160804 | A1* | 5/2020 | Fujikawa | G09G 3/3611 |

FOREIGN PATENT DOCUMENTS

| | | |
|---|---|---|
| CN | 101312022 | 11/2008 |
| CN | 101577085 | 11/2009 |
| CN | 102396020 | 3/2012 |
| CN | 105206208 | 12/2015 |
| CN | 105551449 | 5/2016 |
| CN | 106448579 A | 2/2017 |
| CN | 106531068 A | 3/2017 |

* cited by examiner

DISPLAY DEVICE, SOURCE DRIVE CIRCUIT AND DISPLAY SYSTEM

CROSS-REFERENCE TO RELATED APPLICATIONS

This application is a national stage application of PCT/CN2018/101703, which claims priority to Chinese Application No. 201710884727.4, filed on Sep. 26, 2017. The Chinese Application and international application are incorporated herein by reference in their entireties.

FIELD OF TECHNOLOGY

The present disclosure relates to a technical field of display, in particular, to a display device, a source driving circuit and a display system.

BACKGROUND

In recent years, with the continuous development of display technology, the market demand for display devices is growing greater and greater, so the market demand for display driver chips is also growing greater and greater. A display device generally comprises an array of pixels and a display driver chip, wherein the display driver chip is mainly used to implement a source driving circuit, a gate driving circuit, a timing control circuit, etc. The array of pixels includes a plurality of pixel units, each pixel unit is connected to the source driving circuit through a corresponding data line for receiving a corresponding source driving signal, each pixel unit is connected to the gate driving circuit through a corresponding scanning line for receiving a corresponding the gate driving signal.

The charging time and the discharging time allotted to each data line are limited, thus, when the array of pixels is driven by the source driving circuit, whether the source driving circuit can complete a process to charge a pixel unit within the limited charging time or discharge the pixel unit within the limited discharging time is mainly affected by the following three factors: the capacitance and the parasitic resistance of the pixel unit; the driving capability of the operational amplifier in the source driving circuit; and the parasitic situation on the power-supply line in the circuit layout. In the above three factors, the capacitance and the resistance of the pixel unit are determined by the manufacturing process of the panel manufacturer, the driving capability of the operational amplifier in the source driving circuit can usually meet the design requirements, therefore, the parasitic situation on the power-supply line in the circuit layout may become a major restriction factor. In one aspect, as the functions of the apparatus having the display device becoming increasingly varied and the resolution of the display device continuously increasing, the charging time and discharging time allotted to each data line is getting shorter and shorter, especially, in relating apparatus using touch and display driver integration (TDDI) technology, since the implementation of touch function need to use a portion of the operating time of the display device, the charging time and the discharging time allotted to each data line is relatively short, requiring the power-supply line designed in the circuit layout to have a larger width; however, on the other hand, due to low-cost design requirement on display devices, the width of the power-supply line is limited, making it difficult to meet the requirement to reduce the charging time and the discharging time.

SUMMARY

In order to solve the above-described problems in prior art, the present disclosure can reduce parasitic resistance of the power supply line by use of an equalization line during the period when the equalization line is under idle status, so that problems on layout can be solved by a circuit schematic design method, which improves driving capability of the source driving circuit and reduces time for the source driving circuit to charge and discharge a pixel unit in the display device.

According to a first aspect of the present disclosure, there is provided a source driving circuit, comprising: a plurality of source driving units, each of which is configured to generate a corresponding source driving signal; a power supply line, configured to provide a power supply voltage, wherein a plurality of power supply nodes are distributed on the power supply line and each one of the plurality of source driving units is connected to a corresponding one of the plurality of power supply nodes to receive the power supply voltage; an equalization line, connected to each one of the plurality of source driving units and having a receiver end for receiving an equalizing voltage, each of the source driving unit connected to said equalization line; and a first switching transistor connected in the equalization line in series, having a control terminal to receive a first enable signal, wherein, under a circumstance that the first enable signal is active, the first switching transistor is turned on and the equalizing line provides the equalizing voltage to each one of the plurality of source driving units, under a circumstance that the first enable signal is inactive, the first switching transistor is turned off to stop providing the equalizing voltage to the equalization line, at least a portion of said equalization line is connected to at least a portion of the power supply line in parallel.

Preferably, the source driving circuit further comprises a plurality of second switching transistors, each of which has a control terminal to receive a second enable signal, first terminals of the plurality of second switching transistors are connected to the power supply line at different positions, respectively, second terminals of the plurality of second switching transistors are connected to the equalization line at different positions, respectively, when the equalization line provides the equalizing voltage, the plurality of second switching transistors are turned off by the second enable signal, and when the equalization line stops receiving the equalizing voltage, the plurality of second switching transistors are turned on by the second enable signal.

Preferably, the first switching transistor and the plurality of second switching transistors are MOSFETs with a same channel type, the second enable signal is an inverted signal of the first enable signal.

Preferably, the first switch is a MOSFEET having a first channel type, each one of the second switching transistor is a MOSFET having a channel type different from the first channel type, and the second enable signal is same to the first enable signal.

Preferably, the plurality of second switching transistors, the plurality of source driving units in the source driving circuit and the plurality of power supply nodes on the power supply line have a same amount.

Preferably, each one of the first terminals of the plurality of second switching transistors is connected to an adjacent one of the power supply nodes, thus, the first terminals of the plurality of second switching transistors are connected to different power supply nodes.

Preferably, the receiver end of the equalization line is adjacent to the first switching transistor and is connected to the first switching transistor.

Preferably, a charging process of the source driving circuit is divided into a first time period and a second time period after the first time period, wherein during the first time period, each one of the plurality of source driving units provides the equalizing voltage as the corresponding source driving signal, the first enable signal is active, while during the second time period, each one of the plurality of source driving units generates the corresponding source driving signal in accordance with image data, the second enable signal is inactive; a discharging process of the source driving circuit is divided into a third time period and a fourth time period after the third time period, wherein during the third time period, each one of the plurality of source driving units provides the equalizing voltage as the corresponding source driving signal, and the first enable signal is active, while during the fourth time period, each one of the source driving units provides the corresponding source driving signal having a voltage lower than the equalizing voltage, and the first enable signal is invalid.

Preferably, durations of the first time period and the second time period is determined by loading status of the source driving circuit.

Preferably, each of the plurality of source driving units comprises: a grayscale voltage generation module, configured to generate a grayscale voltage according to the image data and the power supply voltage; an output switching module, configured to output the equalizing voltage as the source driving signal during the first time period of the charging process and the third time period of the discharging process, and to output the grayscale voltage as the source driving signal during the second time period of the charging process and the fourth time period of the discharging process.

According to a second aspect of the present disclosure, there is provided a display device comprising: a plurality of scanning lines and a plurality of data lines; a pixel array including a plurality of pixel units, each one of the plurality of pixel units is connected to a corresponding one of the plurality of scanning lines for receiving a corresponding gate driving signal and is connected to a corresponding one of the plurality of data lines for receiving a corresponding source driving signal; a gate driving circuit, configured to provide corresponding gate driving signals to the plurality of scanning lines, respectively; and the source driving circuit as mentioned in previous embodiments, wherein each one of the plurality of source driving units is at least connected to one of the plurality of data lines to provide the corresponding source driving signal.

According to a third aspect of the present disclosure, there is provided a display system comprising any of the above-described source driving circuit.

According to a fourth aspect of the present disclosure, there is provided a display system, comprising any of the above-described display devices.

Compared to conventional display devices and conventional source driving circuits, the source driving circuit according to the present disclosure have at least a portion of the equalization line connected in parallel with at least a portion of the power supply line during the time period when the equalization line is under idle state, thereby reducing the parasitic resistance of the power supply line, i.e., solving a problem on circuit layout by use of a circuit schematic design method, improving the driving capability of the source driving circuit, reducing required time for the source driving circuit to charge and discharge the pixel units in the display device.

BRIEF DESCRIPTION OF THE DRAWINGS

The above-mentioned or other objectives, technical features and advantages of the present disclosure can be clearly described by referring to the following figures.

DESCRIPTION OF THE EMBODIMENTS

Figure 1:
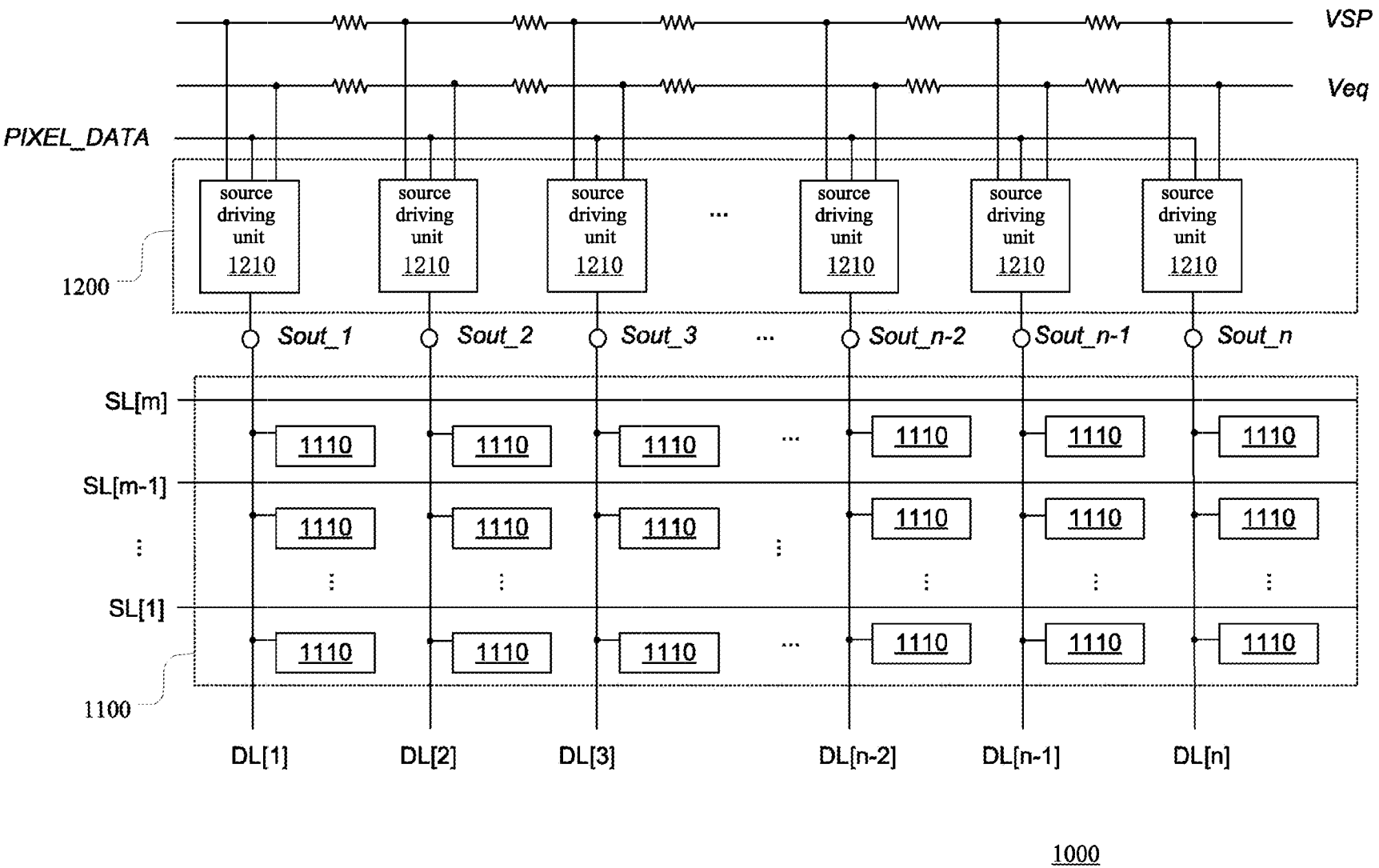
FIG. 1 shows a schematic circuit diagram of a conventional display device.

Various exemplary embodiments, features and aspects of the present disclosure will be described in detail hereinafter with reference to the drawings. Like reference symbols in the various drawings indicate like elements. For clarity, various parts of the drawings are not drawn to scale. In addition, lead out lines, in addition to lines corresponding to driving electrodes and sensing electrodes, are not shown in the drawings, and some well-known portion may not be shown in the drawings.

In the following description of the present disclosure, numerous specific details, such as device structure, material, dimension, process and technology, are described to make the present disclosure more clearly understood. However, those skilled in the art should understand that the present disclosure can be implemented without these specific details.

FIG. 1 shows a schematic circuit diagram of a conventional display device.

As shown in FIG. 1, the conventional display device 1000 mainly includes a pixel array 1100, a plurality of data lines DL[1] to DL[n], a plurality of scanning lines SL[1] to SL[m], a source driving circuit 1200, a gate driving circuit (not shown) and a timing control circuit (not shown), where m and n are non-zero natural numbers.

The pixel array 1100 comprises a plurality of pixel units 1110 arranged in an array, each pixel unit includes a thin film transistor TFT, a pixel electrode, a common electrode, etc. A liquid crystal capacitor Clc is formed by the pixel electrode and the common electrode, the common electrode is generally configured to receive a common voltage Vcm, the pixel electrode is connected to the drain electrode of the thin film transistor TFT in order to receive a corresponding grayscale voltage Sout when the thin film transistor TFT is turned on. Usually, the pixel array 1100 is a matrix formed by m rows and n columns of the pixel units 1110.

The gate driving circuit (not shown) is connected to the plurality of pixel units through a plurality of scanning lines SL[1] to SL[m], so that the gate electrode of the thin film transistor in each pixel unit can receive a corresponding gate driving signal from the gate driving circuit through a corresponding one of the plurality of scanning lines. Generally, the thin film transistors arranged in a same row of the pixel array each have a gate electrode connected to a same one of the scanning lines, the gate driving signals provided to the plurality of scanning lines are configured to turn on the thin film transistors in the pixel array row by row.

The source driving circuit 1300 is connected to the plurality of pixel units through a plurality of data lines DL[1] to DL[n], so that the source electrode of the thin film transistor in each pixel unit can receive a corresponding source driving signal Sout_1 to Sout_n from the source driving circuit 1300 through a corresponding one of the plurality of data lines. Generally, if the pixel array 1100 is rectangular, the thin film transistors arranged in a same column of the pixel array each have a source electrode connected to a same one of the data lines to receive a same source driving signal. In each pixel unit, each thin film transistor under turn-on state can provide a corresponding source driving signal to a corresponding pixel electrode, thereby the pixel units can realize image display in accordance with the corresponding source driving signals.

Figure 2A:
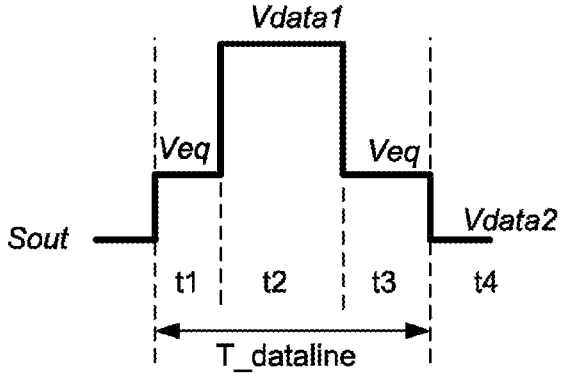
FIG. 2*a* shows a waveform diagram of a source driving signal provided by a source driving unit in a conventional display device under light load condition.
Figure 2B:
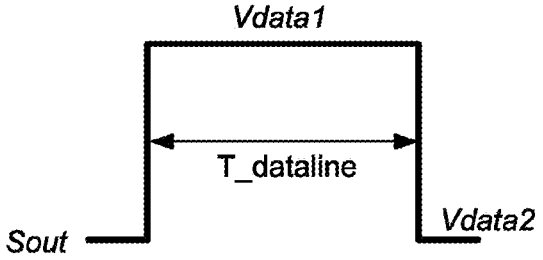
FIG. 2*b* shows a waveform diagram of a source driving signal provided by a source driving unit in a conventional display device under heavy load condition.

Specifically, as shown in FIG. 1, the source driving circuit 1200 includes a plurality of source driving units 1210, a power supply line and an equalization line, each source driving unit 1210 is respectively connected to a corresponding data line to provide a corresponding source driving signal. Generally, each source driving unit 1210 has a power supply terminal, an equalizing terminal, a data input terminal and an output terminal, the power supply terminal of each source driving unit is connected to the power supply line to receive power supply voltage VSP, the equalizing terminal of each source driving unit is connected to the equalizing line to receive the equalizing voltage Veq, the data input terminal of each source driving unit is connected to input data line to receive a corresponding image data PIXEL_DATA, which is, for example, a 8-bit digital signal, and the output terminal of each source driving unit is connected to a corresponding data line to provide a corresponding one of the source driving signals Sout_1 to Sout_n, FIG. 2*a* shows a waveform diagram of a source driving signal provided by the source driving unit in a conventional display device under light load condition. FIG. 2*b* shows a waveform diagram of a source driving signal provided by the source driving unit in a conventional display device under heavy load condition.

Under light load condition, as shown in FIG. 2*a*, the pixel electrode in the corresponding pixel unit can be charged and discharged by the source driving unit 1210 in a relatively short period of time, so that, under light load condition, although time T_dataline allotted for driving each data line is limited, there is still enough time for equalization operation. Specifically, during the charging process for each source driving unit, the corresponding pixel electrode is firstly charged to the equalizing voltage lower than grayscale voltage Vdata1 in a first time period t1, and is then charged to the grayscale voltage Vdata1, which is generated by the source driving unit in accordance with image data PIXEL_DATA and is greater than the equalizing voltage Veq, in a second time period t2 after the first time period t1, thereby saving power consumption required by charging process; likewise, during the discharging process for each source driving unit, the corresponding pixel electrode is firstly discharged to the equalizing voltage Veq in a third time period t3, and is then discharged to grayscale voltage Vdata2, which is generated by the source driving unit in accordance with the image data PIXEL_DATA and is lower than the equalizing voltage Veq, in the fourth time period after the third time period and before starting a next driving process, thereby saving power consumption required by discharging process.

Under heavy load condition, as shown in FIG. 2*b*, the source driving unit 1210 need to take a long time to charge and discharge a corresponding pixel electrode, thus, it is possible to cancel or reduce the execution time of the above-described equalization operation, which is processed during the first time period t1 of the charging process and the third time period of the discharging process.

In the conventional display device 1000, as shown in FIG. 1, when the pixel array is an m*n matrix, i.e., the pixel units included in the pixel array are arranged in m rows and n columns, the resolution of the display device 1000 is m*n. Driving time T_dataline=1/(f*m) is allotted for each data line, where f represents the refresh frequency of the display device. With the development of display technologies, marketing requirement on the resolution of the display device is becoming higher and higher, therefore, according to the above formula, the charging time for the pixel unit corresponding to each data line is getting shorter and shorter. However, it can be seen from FIG. 1 that, there is a larger number of source driving unit 1210 in the source driving circuit 1200, the plurality of source driving units are distributed to different locations according to the layout of the data lines, therefore the power supply line and the equalization line connected to each source driving unit should be implemented by long wires (typically up to tens of microns), and are usually required to extend from the leftmost end to the rightmost end of the chip for implementing the source driving circuit. The parasitic resistance of the metal line can be expressed by formula. R=(L/W)*R_unit, where L represents the length of the metal line, W represents the width of the metal line and R_unit represents the sheet resistance value, thus the parasitic resistance of the power supply line and the parasitic resistance of the equalization line are very large, which greatly limits the driving capability of the source driving circuit 1200 and increases the charging time and the discharging time required by each pixel unit, that is, the driving time required to be allotted for each data line is increased.

In the prior art, in order to reduce the parasitic resistances of the power supply line and the equalization line, a general method is to directly widen the power line and the equalization line on the circuit layout, but this method will increase layout area, thus increasing manufacturing cost on the display device.

Figure 3:
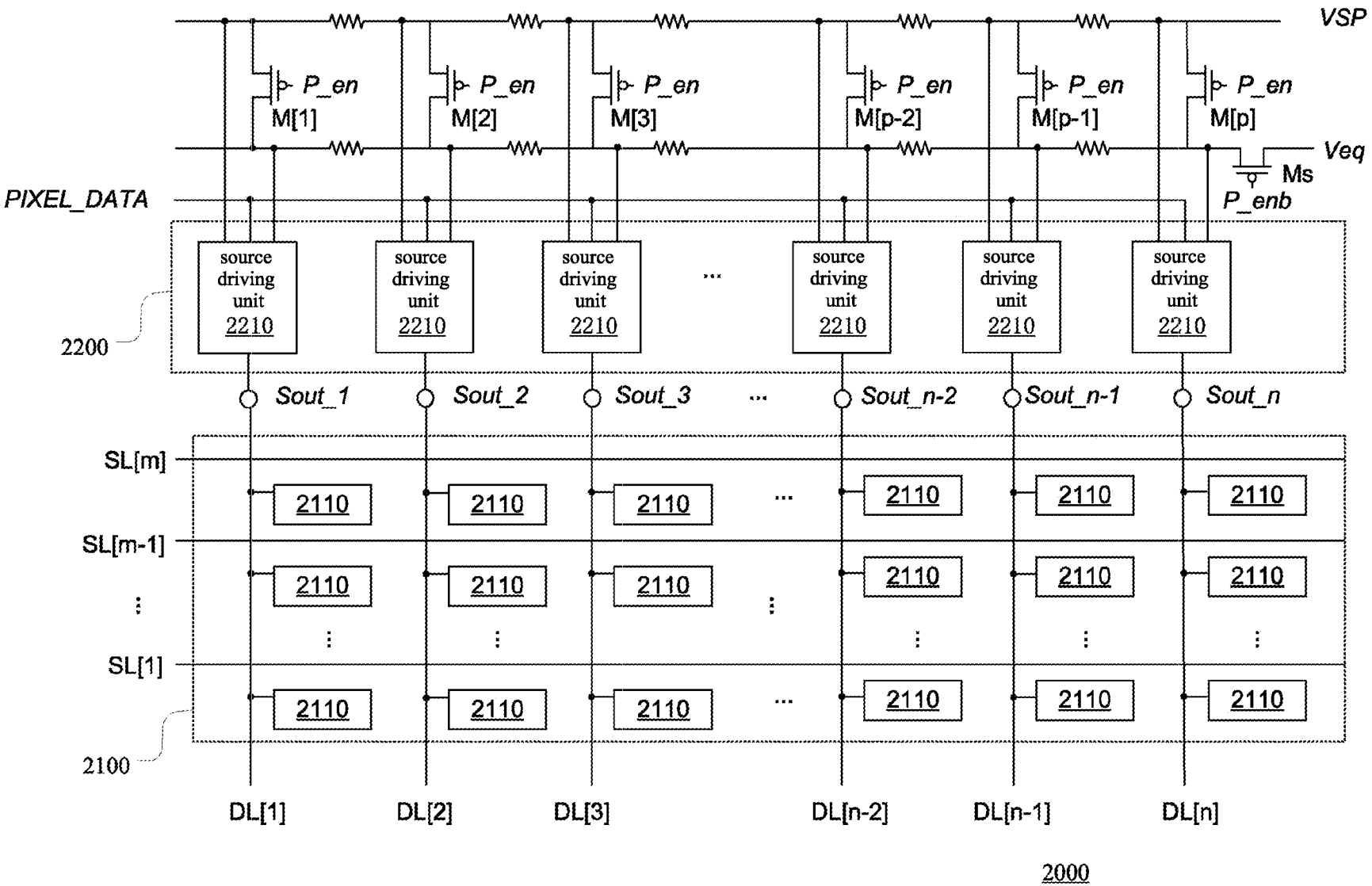
FIG. 3 shows a schematic circuit diagram of a display device according to an embodiment of the present disclosure.
Figure 4:
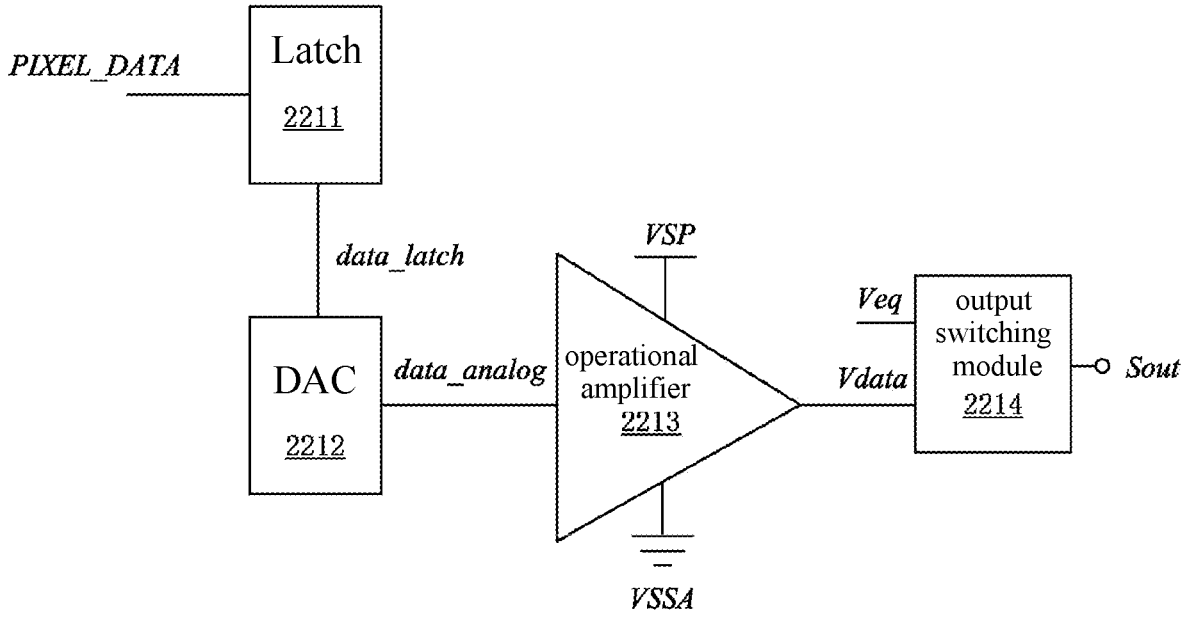
FIG. 4 shows a diagram of a source driving unit in the source driving circuit shown in FIG. 3.

FIG. 3 shows a schematic circuit diagram of a display device according to an embodiment of the present disclosure. FIG. 4 shows a schematic diagram of a source driving unit in the source driving circuit shown in FIG. 3.

As shown in FIG. 3, the display device 2000 in accordance to the embodiment of the present disclosure mainly comprises a pixel array 2100, a plurality of data lines DL[1] to DL[n], a plurality of scanning lines SL[1] to SL[m], a source driving circuit 2200, a gate driving circuit (not shown) and a timing control circuit (not shown), where m and n are non-zero natural numbers.

The pixel array 2100 comprises a plurality of pixel units 2110 arranged in an array, each pixel unit 2110 comprises a thin film transistor TFT, a pixel electrode, a common electrode, etc. Wherein, the pixel electrode and the common electrode form a liquid crystal capacitor Clc, the common electrode generally receives a common voltage Vcm, the pixel electrode is connected to the drain electrode of the thin film transistor to receive a corresponding grayscale voltage Sout when the thin film transistor TFT is turned on. In the embodiment, the pixel array 1100 is formed by a matrix having m rows and n columns of pixel units, however, the present disclosure is not limited to this embodiment, those skilled in the art may set the pixel array 2100 in other forms in accordance with practical requirements.

The gate driving circuit (not shown) is configured to connect to the plurality of pixel units through a plurality of scanning lines SL[1] to SL[m] for providing corresponding gate driving signals, the thin film transistor in each pixel unit has a gate electrode receiving the corresponding gate driving signal. Generally, the thin film transistors arranged in a same row of the pixel units each have a gate electrode connected to a same scanning line, and the gate driving signals provided by the scanning lines are configured to turn on the thin film transistors row by row.

The source driving circuit 2300 is connected to the plurality of pixel units, to provide corresponding source driving signals Sout_1 to Sout_n respectively through the plurality of data lines DL[1] to DL[n], and the source electrode of the thin film transistor in each pixel unit is coupled to the source driving circuit to receive a corresponding one of the source driving signals Sout_1 to Sout_n. In the embodiment, the thin film transistors arranged in a same column of the pixel units each have a source electrode connected to a same one of the data lines to receive a corresponding source driving signal. In each pixel unit, each of the thin film transistors under turn-on state can provide the corresponding source driving signal to the corresponding pixel electrode, thereby the pixel unit can realize image display according to the corresponding source driving signals.

Specifically, as shown in FIG. 3, the source driving circuit 2200 comprises a plurality of source driving units 2210, a power supply line and a equalization line, each source driving unit 2210 is connected to a corresponding data line to provide a corresponding source driving signal. The power supply line is configured to provide a supply voltage VSP, a plurality of power supply nodes are distributed on the power supply line. Each source driving unit 2210 has a power supply terminal, an equalization terminal, a data input terminal and an output terminal, the power supply terminal of each source driving unit 2210 is connected to a corresponding power supply node to receive the power supply voltage VSP, the equalization terminal of each source driving unit 2210 is connected to the equalization line to receive the equalizing voltage Veq, and the data input terminals the plurality of source driving units are connected to a data input line to receive image data PIXEL_DATA, which is, for example, a 8-bit digital signal, the output of each of the source driving unit is respectively connected to a corresponding data line to provide a corresponding one of the source driving signals Sout_1 to Sout_n.

Further, as shown in FIG. 4, each of the source driving unit 2210 comprises a latch 2211, a digital to analog converter 2212, an operational amplifier 2213 and an output switching module 2214, wherein the latch 2211, the digital to analog converter 2212, and the operational amplifier 2213 cooperate together as a grayscale voltage generating module, configured to generate the corresponding gray scale voltage Vdata according to the image data PIXEL_DATA.

An input terminal of the latch 2211 serves as the data input terminal of the source driving unit, the latch 2211 is configured to preform latching and buffering on the image data PIXEL_DATA to obtain latch data (data_latch); the digital to analog converter 2212 is configured to convert the digital signal data_latch into an analog data signal (data_analog); the operational amplifier 2213 is configured to buffer the analog data signal (data_analog) to obtain the grayscale voltage Vdata representing image information, the power supply terminal of the operational amplifier 2213 serves as the power supply terminal of the source driving unit to receive the power supply voltage VSP, a ground terminal of the operational amplifier 2213 is coupled to an analog ground VSSA; the output switching module 2214 receives the grayscale voltage Vdata provided from the operational amplifier 2213, and obtains the equalizing voltage Veq through the equalization terminal of the source driving unit, thereby generating the source driving signal Sout in accordance with the grayscale voltage Vdata and the equalizing voltage Veq.

Different from the conventional display device 1000, the display device 2000 according to an embodiment of the present invention further comprises a plurality of second switches M[1] to M[p], and a first switch Ms, where p is a non-zero natural number.

A control terminal of each one of the second switching transistors M[1]~M[p] is configured to receive a second enable signal P_en, a first terminal of each one of the second switching transistors M[1]~M[p] is connected to the power supply line, a second terminal of each one of the second switching transistors M[1]~M[p] is connected to the equalization line. Preferably, the plurality of second switching transistors M[1]~M[p] are respectively arranged along the power supply line and the equalization line at specific intervals. Further, as a preferable embodiment, the value of p is equal to the column number n of the pixel array, and is also equal to the number of the source driving units, the first terminals of different ones of the second switching transistors M[1]~M[p] are adjacently coupled to different power supply nodes, respectively.

The control terminal of the first switching transistor Ms receives a first enable signal P_enb, each one of the plurality of second switching transistors is turned off by the second enable signal P_en when the equalizing voltage Veq is provided by the equalization line, and each one of the plurality of second switching transistors is turned on by the second enable signal P_en when the equalization line does not receive the equalizing voltage Veq. The first switching transistor Ms is connected in series on the equalization line, the receiver end of the equalization line receives the equalizing voltage Veq and is adjacently connected to the first switching transistor Ms.

Under a circumstance that the first switching transistor Ms is turned off by the first enable signal P_enb, and the second switching transistors M[1]~M[p] are turned on by the second enable signal P_en, at least a portion of the equalization line can be connected to at least a portion of the power supply line in parallel through the second switching transistors M[1]~M[p], so that the parasitic resistance of the power supply line can be connected to the parasitic resistance of the equalization line in parallel, i.e. the parasitic resistance of the line for power supply is reduced, thereby reducing the driving time required by the data lines, and reducing the driving time to drive the respective pixel units.

Under a circumstance that the first switching transistor Ms is turned on by the first enable signal P_enb, and the second switching transistors M[1]~M[p] are turned off by the second enable signal P_en, the equalization line is configured to receive the equalizing voltage, and the source driving units coupled to the equalization line can normally receive the equalizing voltage.

It should be noted that, the first switching transistor and each of the second switching transistors may be implemented by MOSFETs of a same channel type, and under this circumstance, the second enable signal P_en is the inverted signal of the first enable signal P_enb; under another circumstance, the first switching transistor may be implemented by a MOSFET of a first channel type, each of the second switching transistor may be implemented by a MOSFET of a second channel type different from the first channel type, and the second enable signal P_en can be the same with the first enable signal P_enb.

Figure 5A:
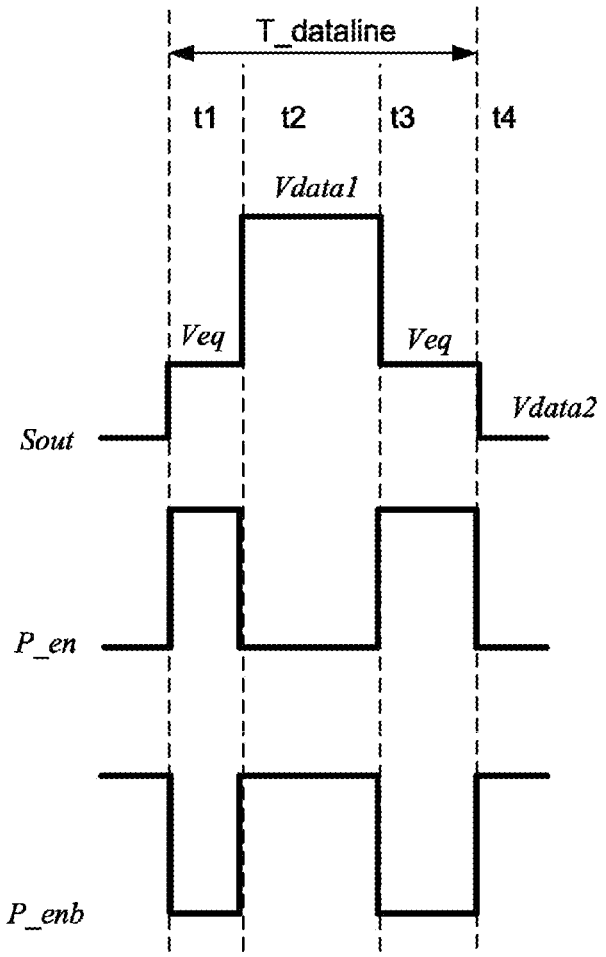
FIG. 5*a* shows an operation timing diagram of a display device under light load condition according to an embodiment of the present disclosure.
Figure 5B:
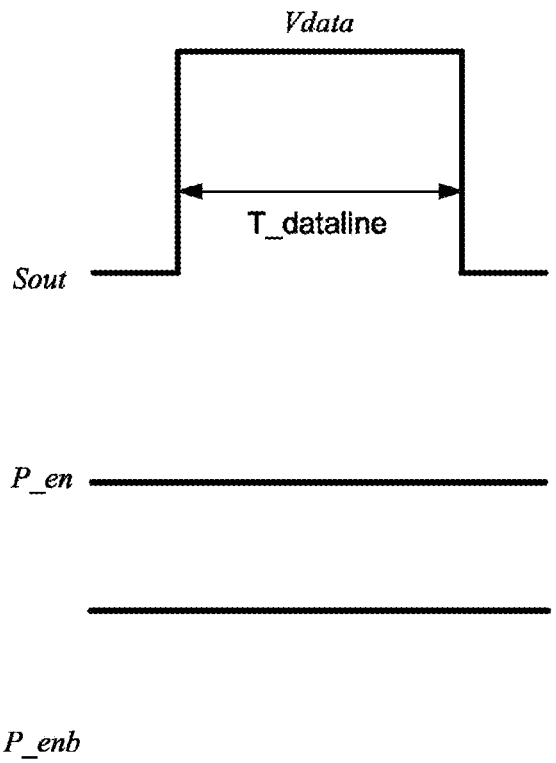
FIG. 5*b* shows an operation timing diagram of a display device under heavy load condition according to an embodiment of the present disclosure.

FIG. 5*a* shows an operation timing diagram of a display device under light load condition according to an embodiment of the present disclosure. FIG. 5*b* shows an operation timing diagram of a display device under heavy load condition according to an embodiment of the present disclosure. It should be noted that, the light load condition and the heavy load condition are mentioned here as relative concepts, depending on different pixel array and the resolution ratio corresponding to the operation mode of the pixel array, those skilled in the art may set a critical threshold value in accordance with the specific circumstance of different display device, as an example, the source driving unit may be considered to operate under light load condition if a parameter relating to the load is lower than the critical threshold value, while the source driving unit may be considered to operate under heavy load condition if the parameter relating to the load is greater than or equal to the critical threshold value.

Under light load condition, as shown in FIG. 5*a*, the charging process and the discharging process performed on the pixel electrodes of corresponding pixel units 2210 can be completed by the source driving unit 2210 in a short time period, so that there is still enough time for the equalization operation, even though the driving time dataline allotted to each data line is limited under light load condition. Specifically, during the charging process performed on each source driving unit: in a first time period t1, the corresponding pixel electrodes are firstly charged to the equalizing voltage Veq lower than the grayscale voltage Vdata1 by the output switching module 2214, the first switching transistor Ms is conductive under control of the active first enable signal P_enb to allow the equalization line to receive the equalizing voltage Veq, the output switching module 2214 is configured to directly supply the equalizing voltage Veq, provided by the equalization line, to the plurality of pixel units; in a second time period t2 after the first time period, the equalization line is used to transmit the power supply voltage VSP, and to generate the grayscale voltage Vdata1 higher than the equalizing voltage Veq according to the analog data signal data_analog which is provided by the digital to analog converter, the output switching module 2214 is configured to output the grayscale voltage Vdata1 as the source driving voltage Sout to the corresponding pixel unit, under this circumstance, the second switching transistors M[1]~M[p] are conductive under control of the active second enable signal P_en and the first switching transistor Ms is turned off under the inactive first enable signal P_enb, thus, by use of the parasitic resistance of the equalization line, the parasitic resistance of the line for providing power supply can be reduced, so that time for the source driving unit to complete the charging process on the pixel electrodes in corresponding pixel units can be shortened, and power consumption required in the charging process can be saved. Similarly, during the discharging process performed on each source driving unit: in a third time period t3, the corresponding pixel electrodes are firstly discharged to the equalizing voltage Veq, the first switching transistor Ms is conductive under control of the active first enable signal P_enb to allow the equalization line to receive the equalizing voltage Veq, the output switching module 2214 is configured to directly supply the equalizing voltage Veq, provided by the equalization line, to the plurality of pixel units; in a fourth time period t4 after the third time period and before the next driving period, voltages at corresponding pixel electrodes are discharged to the grayscale voltage Vdata2 lower than the equalizing voltage Veq, and the second switching transistors the equalization line is used to transmit the power supply voltage VSP, and to generate the grayscale voltage Vdata1 higher than the equalizing voltage Veq according to the analog data signal data_analog which is provided by the digital to analog converter, the output switching module 2214 is configured to output the grayscale voltage Vdata1 as the source driving voltage Sout to the corresponding pixel unit, under this circumstance, the second switching transistors M[1]~M[p] are conductive under control of the active second enable signal P_en and the first switching transistor Ms is turned off under the inactive first enable signal P_enb, thus, by use of the parasitic resistance of the equalization line, the parasitic resistance of the line for providing power supply can be reduced, so that the power consumption required by the source driving unit can be saved time, meanwhile, time to complete the discharging process on the pixel electrodes in corresponding pixel units can be reduced.

Under heavy load condition, as shown in FIG. 5*b*, the source driving unit 2210 need to take a long time to complete the charging process and the discharging process for a corresponding pixel electrode, thus it is possible to exclude the equalization operation from the source driving process or reduce execution time for the above-described equalization operation which comprises the first time period t1 during the charging process and the third time period t3 during the discharging process. Operation timing diagram according to an embodiment in which the execution time for equalization operation is reduced, is similar to the operation timing diagram shown in FIG. 5*a*, based on this, only an operation timing diagram according to an embodiment in which the equalization operation is excluded in the source driving process is shown in FIG. 5*b*. Referring to FIG. 5*b*, because the equalization operation is eliminated, there is no need to provide the equalizing voltage, thus under the heavy load condition, the second enable signal P_en is active, the first enable signal P_enb is inactive, thereby the parasitic resistance of the equalization line is always connected to the parasitic resistance of the power supply line in parallel by use of the a second switching transistors M[1]~M[p], equivalent of increasing the width of the power supply line by a circuit schematic design method, so that the driving time required by the data lines can be reduced, that is, time for driving the pixels units is reduced.

Figure 6A:
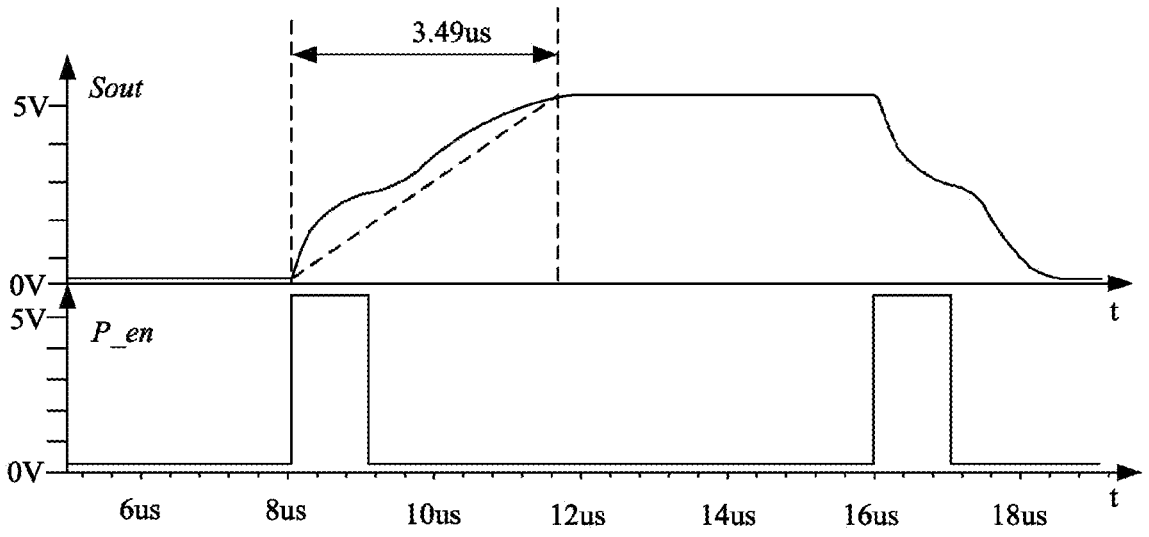
FIG. 6*a* shows simulation waveform diagrams of signals in a source driving unit under light load condition according to an embodiment of the present disclosure.
Figure 6B:
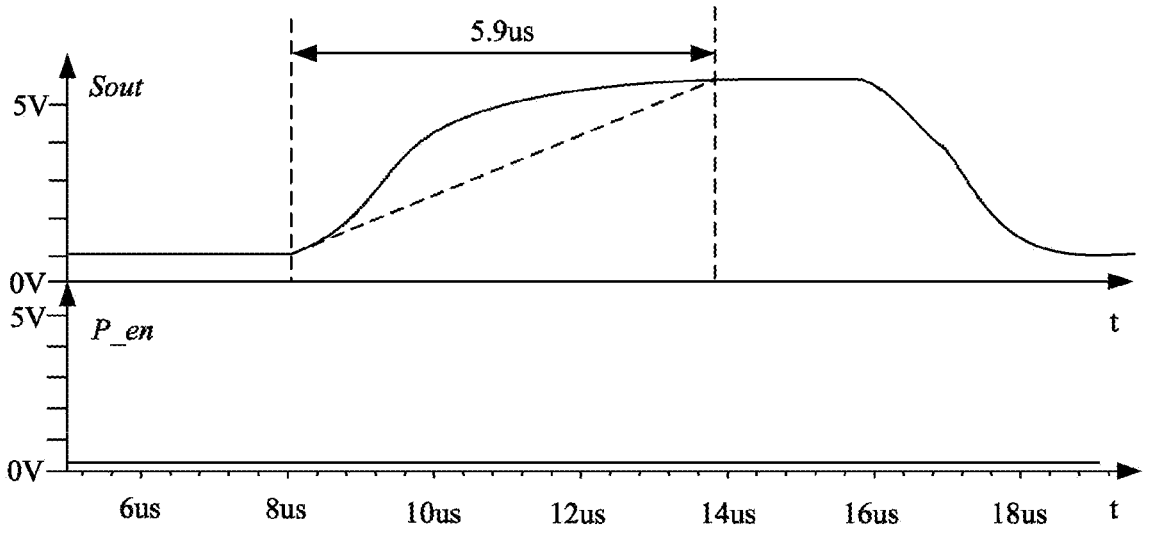
FIG. 6*b* shows simulation waveform diagrams of signals in a source driving unit under heavy load condition according to an embodiment of the present disclosure.

FIG. 6*a* shows simulation waveform diagrams of signals in a source driving unit under light load condition according to an embodiment of the present disclosure. FIG. 6*b* shows simulation waveform diagrams of signals in a source driving unit under heavy load condition according to an embodiment of the present disclosure. Wherein, according to a specific embodiment: the power supply voltage VSP is, for example, 5.5V; the equalizing voltage Veq is, for example, 2.8V; the grayscale voltage Vdata1 during the charging process is, for example, 5.3V; the grayscale voltage Vdata2 during the discharging process is, for example, 0.45V.

As can be seen from FIGS. 6*a* and 6*b*, under light load condition, time for the source driver unit to charge the corresponding pixel electrode to reach the grayscale voltage Vdata1 is around 3.49 us, while the conventional display device under the same condition typically requires 3.61 us to charge the pixel electrode to reach the grayscale voltage Vdata1, therefore, the source driving unit under light load condition according to an embodiment of the present disclosure can reduce the time required for charging by about 3.3%; under heavy load condition, time for the source driving unit to charge the corresponding pixel electrode to reach the grayscale voltage Vdata1 is about 5.9 us, while the conventional display device under the same condition typically requires 6.57 us to charge the pixel electrode to reach the grayscale voltage Vdata1, therefore, the source driving unit under heavy load condition according to an embodiment of the present disclosure can reduce the time required for charging by about 10.2%.

It should be noted that the source driving circuit or the display device according to an embodiment of the present disclosure may be used in a display system for improving display quality.

The time required for charging the corresponding pixel electrode is generally used to characterize the ability of the source driving unit, therefore, compared to the conventional display device and the conventional source driving circuit, the source driving circuit according to an embodiment of the present disclosure is configured to connect at least a portion of the equalization line to at least a portion of the power supply line in parallel under the circumstance that the equalization line is under idle state, thereby reducing the parasitic resistance of the line for providing power supply, that is, solving a circuit layout design problem by use of a circuit schematic design method, improving the driving capability of the source driving circuit, reducing time for the source driving circuit to charge and discharge corresponding pixel units in the display device.

In the present specification, the terms "row" and "column" are not limited to the concept shown as the longitudinal and transverse concepts illustrated in the drawings, according to actual needs, embodiments in line with the basic principles of the present disclosure are within the protection scope of the present invention.

It should be noted that, herein, relational terms such as first and second and the like are only used to distinguish one entity or operation from another entity or operation separate, without necessarily requiring or implying the presence of any such actual relationship or order among these entities or operations. Further, the term "comprising", "containing" or any other variation thereof are intended to cover a non-exclusive inclusion, such that a process, method, article, article, or apparatus may not only include those elements but may further comprises other elements which are not expressly listed, or further comprises inherent elements of such process, method, article, or apparatus. If there's no more constraint, an element limited by the wording "include a . . . " does not exclude the embodiment that additional identical elements are existed in such process, method, article, or apparatus.

In accordance with the exemplary embodiments of the present disclosure described above, these embodiments are not well described in all details, and are not intended to limit the disclosure to the precise forms disclosed. It will be readily apparent to one skilled in the art that many modifications and changes can be made in the present disclosure. These embodiments selected to be described in detail in this specification is disclosed to better explain the principles and the practical applications of the present disclosure, thus others skilled in the art can make good use of the present disclosure and make modifications based on the present disclosure. The present disclosure is limited only by the claims and their full scope and equivalents.

The invention claimed is:

1. A source driving circuit used in a display device, comprising:

a plurality of source driving units, each of which is configured to generate a corresponding source driving signal;

a power supply line, configured to providing a power supply voltage, wherein a plurality of power supply nodes are distributed on the power supply line and each one of the plurality of source driving units is connected to a corresponding one of the plurality of power supply nodes to receive the power supply voltage;

an equalization line, having a receiver end for receiving an equalizing voltage, wherein the equalization line is connected to each one of the plurality of source driving units; and a first switching transistor, connected in series in the equalization line and having a control terminal to receive a first enable signal, wherein, under a circumstance that the first enable signal is active, the first switching transistor is turned on and the equalization line provides the equalizing voltage to each one of the plurality of source driving units, while under a circumstance that the first enable signal is inactive, the first switching transistor is turned off to stop providing the equalizing voltage to the equalization line, at least a portion of the equalization line is connected to at least a portion of the power supply line in parallel.

2. The source driving circuit according to claim 1, further comprises a plurality of second switching transistors, each of which has a control terminal to receive a second enable signal, wherein:

first terminals of the plurality of second switching transistors are coupled to the power supply line at different positions, respectively, second terminals of the plurality of second switching transistors are coupled to the equalization line at different positions, respectively, when the equalization line provides the equalizing voltage, the plurality of second switching transistors are turned off by the second enable signal, and when the equalization line stops receiving the equalizing voltage, the plurality of second switching transistors are turned on by the second enable signal.

3. The source driving circuit according to claim 2, wherein said first switching transistor and the plurality of second switching transistors are MOSFET of a same channel type, the second enable signal is an inverted signal of the first enable signal.

4. The source driving circuit according to claim 2, wherein the first switching transistor is a MOSFET having a first channel type, each one of the plurality of second switching transistors is a MOSFET having a channel type different from the first channel type, and the second enable signal is same to the first enable signal.

5. The source driving circuit according to claim 2, wherein the plurality of second switching transistors, the plurality of source driving units in the source driving circuit and the plurality of power supply nodes on the power supply line a same amount.

6. The source driving circuit according to claim 2, wherein, each one of the first terminals of the plurality of second switching transistors is coupled to an adjacent one of the plurality of power supply nodes, thus, the first terminals of the plurality of second switching transistors are connected to different ones of the plurality of power supply nodes, respectively.

7. The source driving circuit according to claim 1, the receiver end of the equalization line is adjacent to the first switching transistor and is coupled to the first switching transistor.

8. The source driving circuit according to claim 1, wherein a charging process of the source driving circuit is divided into a first time period and a second time period after the first time period, during the first time period, each one of the plurality of source driving units provides the equalizing voltage as the corresponding source driving signal, the first enable signal is active, during the second time period, each one of the plurality of source driving units generates the corresponding source driving signal in accordance with image data, the first enable signal is inactive, a discharging process of the source driving circuit is divided into a third time period and a fourth time period after the third time period, during the third time period, each one of the plurality of source driving units provides the equalizing voltage as the corresponding source driving signal, the first enable signal is active, during the fourth time period, each one of the plurality of source driving units provides the corresponding source driving signal having a voltage lower than the equalizing voltage according to the image data, the first enable signal is inactive.

9. The source driving circuit according to claim 8, wherein, durations of the first time period and the second time period are determined by loading status of the source driving circuit.

10. The source driving circuit according to claim 8, wherein each one of the plurality of source driving units comprises:

a grayscale voltage generation module, configured to generate a grayscale voltage according to the image data and the power supply voltage;

an output switching module, configured to output the equalizing voltage as the corresponding source driving signal during the first time period of the charging process and the third time period of the discharging process, and to output the grayscale voltage as the corresponding source driving signal during the second time period of the charging process and the fourth time period of the discharging process.

11. A display device comprising:

a plurality of scanning lines and a plurality of data lines;

a pixel array including a plurality of pixel units, each one of plurality of pixel units is connected to a corresponding one of the plurality of scanning lines for receiving a corresponding gate driving signal and is connected to a corresponding one of the plurality of data lines for receiving a corresponding source driving signal;

a gate driving circuit, configured to provide the corresponding gate driving signal to a corresponding one of the plurality of scanning lines;

the source driving circuit according to claim 1, wherein each one of the plurality of source driving units is connected to at least one of the plurality of data lines to provide the corresponding source driving signal.

12. A display system, comprising the source driving circuit according to claim 1.

13. A display system, comprising the display device according to claim 11.

* * * * *